US006434865B2

(12) United States Patent
Renski et al.

(10) Patent No.: US 6,434,865 B2
(45) Date of Patent: Aug. 20, 2002

(54) BASE EDGE PROTECTION ASSEMBLY FOR AN IMPLEMENT OF A WORK MACHINE

(75) Inventors: William J. Renski, Peoria; James E. Reid, Metamora; Ronald L. Sievers, Brimfield, all of IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/747,139

(22) Filed: Dec. 22, 2000

Related U.S. Application Data

(63) Continuation-in-part of application No. 09/207,984, filed on Dec. 8, 1998.

(51) Int. Cl.[7] ..... E02F 3/36
(52) U.S. Cl. ..... 37/446; 37/449; 172/772.5
(58) Field of Search ..... 37/446, 449, 450, 37/451, 460, 444; 172/810, 811, 772, 772.5

(56) References Cited

U.S. PATENT DOCUMENTS 2,285,039 A * 6/1942 Lowe
3,059,357 A * 10/1962 Irish
3,281,972 A * 11/1966 Kerestes
3,497,973 A * 3/1970 Campbell
3,500,562 A * 3/1970 Reinhard
3,834,567 A * 9/1974 Miller
4,204,349 A * 5/1980 Tallis
4,449,309 A * 5/1984 Hemphill
4,729,180 A * 3/1988 Hendricks
5,743,033 A * 4/1998 Gegel
6,230,424 B1 * 5/2001 Renski et al.

FOREIGN PATENT DOCUMENTS

CA 514976 * 7/1955 ..... 37/446
FR 2583417 * 9/1969 ..... 37/444

* cited by examiner

*Primary Examiner*—Victor Batson
(74) *Attorney, Agent, or Firm*—Maginot, Moore & Bowman; O. Gordon Pence

(57) ABSTRACT

A bucket assembly is disclosed. The bucket assembly includes a bucket having a base edge. The bucket assembly also includes a base edge protection assembly having (i) a digging plate having a forward edge with a pair of notches defined therein so that a tooth is formed from a portion of the digging plate that is interposed between the notches and (ii) a cover plate secured to the digging plate so that an edge slot is defined between the digging plate and the cover plate. The base edge protection assembly is secured to the bucket such that the base edge of the bucket is positioned within the edge slot of the base edge protection assembly.

16 Claims, 7 Drawing Sheets

BASE EDGE PROTECTION ASSEMBLY FOR AN IMPLEMENT OF A WORK MACHINE

This application is a continuation-in-part of co-pending Application Ser. No. 09/207,984, filed on Dec. 8, 1998.

TECHNICAL FIELD

This invention relates generally to an implement of a work machine, and, more particularly, to a base edge protection assembly for an implement of a work machine.

BACKGROUND ART

A work machine, such as an excavator, may include a bucket for moving or excavating dirt or other types of material. A number of teeth are typically attached to a base edge of the bucket in order to facilitate the excavating process. The teeth also help protect the base edge of the bucket from wear and tear encountered during the excavation process. Protection of the base edge extends the life of the bucket and reduces maintenance cost of the work machine. However, the teeth have to be periodically replaced due to the wear and tear they are subjected to during the excavation process.

Heretofore, some teeth have been secured to a bucket by first attaching an adapter to the base edge thereof and then securing the teeth to the adapter via a pin assembly. Typically, these pin assemblies include a number of parts which contact and exert a force on both the adapter and the tooth in order to effect the securement therebetween.

Another approach to secure teeth to a base edge of a bucket is to utilize a tooth bar. In particular, a tooth bar is designed to fit over the base edge of a bucket and a number of adapters are secured to the tooth bar. Replaceable teeth are then secured to the adapters with pin assemblies similar to the ones described above.

One disadvantage of having a pin assembly in contact with both the tooth and the adapter to effect securement therebetween is that the pin assembly may become loose as the tooth is subjected to substantial forces during a work operation. In particular, forces that are applied to the tooth during a work operation would then be transmitted to the pin assembly. Thereafter, forces which are applied to the pin assembly would be transmitted to the adapter. Consequently, the pin assembly would be subjected to a continuous compressing force during the work operation which may cause the pin assembly to become loose over a period of time. The presence of a loose pin assembly may cause inadvertent separation of the tooth from the adapter.

Furthermore, these types of tooth bars and pin assemblies typically include a relatively large number of parts which makes them relatively expensive, mechanically complex, and difficult to install.

The present invention is directed to overcoming one or more of the problems or disadvantages associated with the prior art.

DISCLOSURE OF THE INVENTION

In accordance with one aspect of the present invention, there is provided a base edge protection assembly for an implement of a work machine. The base edge protection assembly includes a digging plate having (i) a first edge and a second edge, (ii) a surface interposed the first edge and the second edge, and (iii) a plurality of notches defined in the first edge of the digging plate so that a number of teeth are integrally formed on the digging plate. The base edge protection assembly also includes a cover plate secured to the surface of the digging plate at a location interposed the first edge and the second edge so that (i) a first portion of the surface extends outwardly from the location in a first direction, (ii) a second portion of the surface extends outwardly from the location in a second direction, and (iii) an edge slot is defined between the digging plate and the cover plate.

In accordance with another aspect of the present invention, there is provided an implement assembly. The implement assembly includes a digging plate having (i) a first edge and a second edge, (ii) a surface interposed the first edge and the second edge, and (iii) a plurality of notches defined in the first edge of the digging plate so that a number of teeth are integrally formed on the digging plate. The implement assembly also includes a cover plate secured to the surface of the digging plate at a location interposed the first edge and the second edge so that (i) a first portion of the surface extends outwardly from the location in a first direction, (ii) a second portion of the surface extends outwardly from the location in a second direction, and (iii) an edge slot is defined between the digging plate and the cover plate. The implement assembly further includes a bucket having a base edge. The bucket is positioned relative to the digging plate and the cover plate so that the base edge is located within the edge slot.

In accordance with yet another aspect of the present invention there is provided a work machine. The work machine includes a digging plate having (i) a first edge and a second edge, (ii) a surface interposed the first edge and the second edge, and (iii) a plurality of notches defined in the first edge of the digging plate so that a number of teeth are integrally formed on the digging plate. The work machine also includes a cover plate secured to the surface of the digging plate at a location interposed the first edge and the second edge so that (i) a first portion of the surface extends outwardly from the location in a first direction, (ii) a second portion of the surface extends outwardly from the location in a second direction, and (iii) an edge slot is defined between the digging plate and the cover plate. The work machine further includes an implement having a base edge. The implement is positioned relative to the digging plate and the cover plate so that the base edge is located within the edge slot.

BEST MODE FOR CARRYING OUT THE INVENTION

Figure 1:
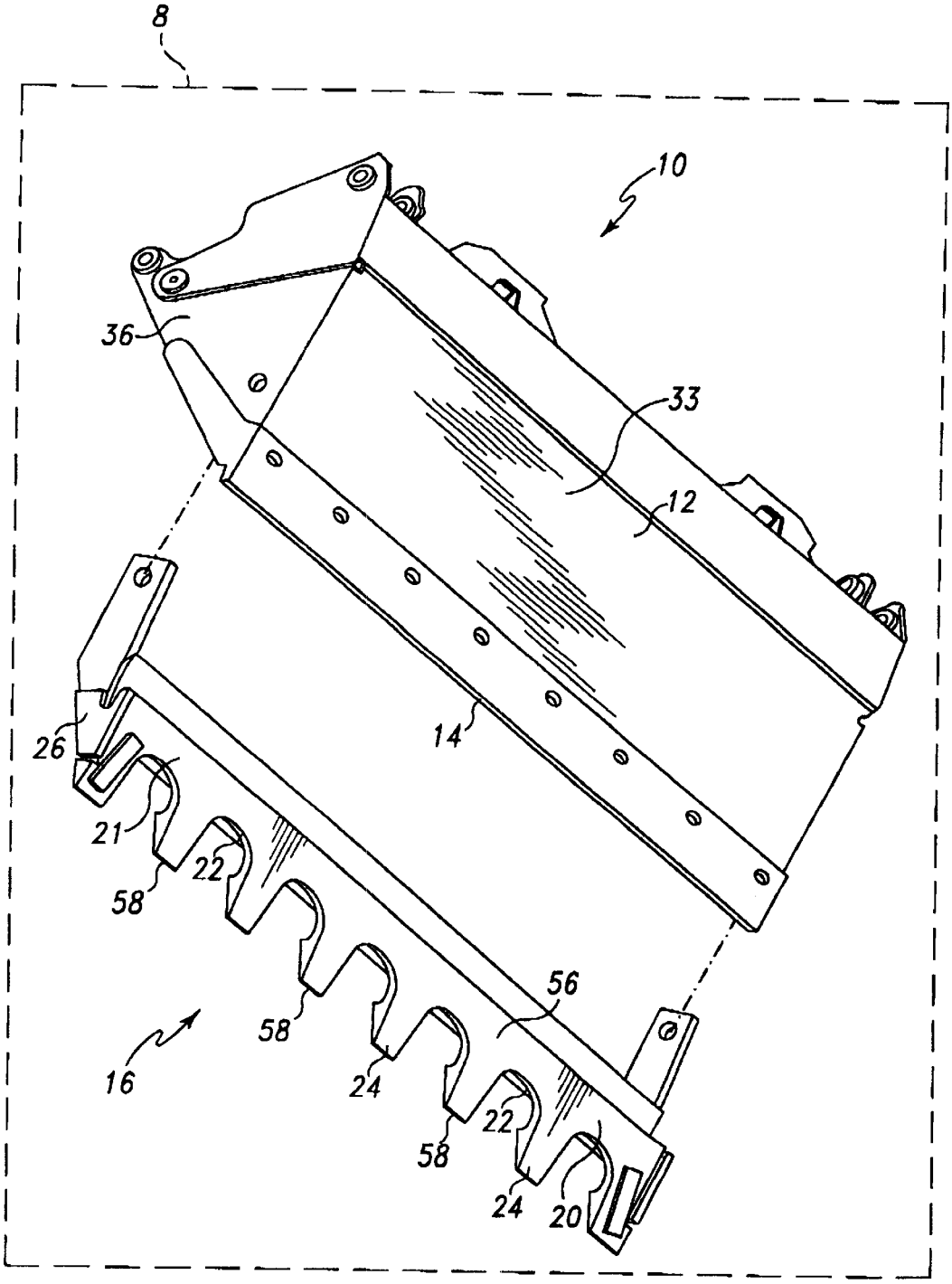
FIG. 1 is schematic representation of a work machine and a partially exploded perspective view of a bucket assembly of the work machine which incorporates features of the present invention therein.

While the invention is susceptible to various modifications and alternative forms, a specific embodiment thereof has been shown by way of example in the drawings and will herein be described in detail. It should be understood, however, that there is no intent to limit the invention to the particular form disclosed, but on the contrary, the intention is to cover all modifications, equivalents, and alternatives falling within the spirit and scope of the invention as defined by the appended claims.

Figure 2:
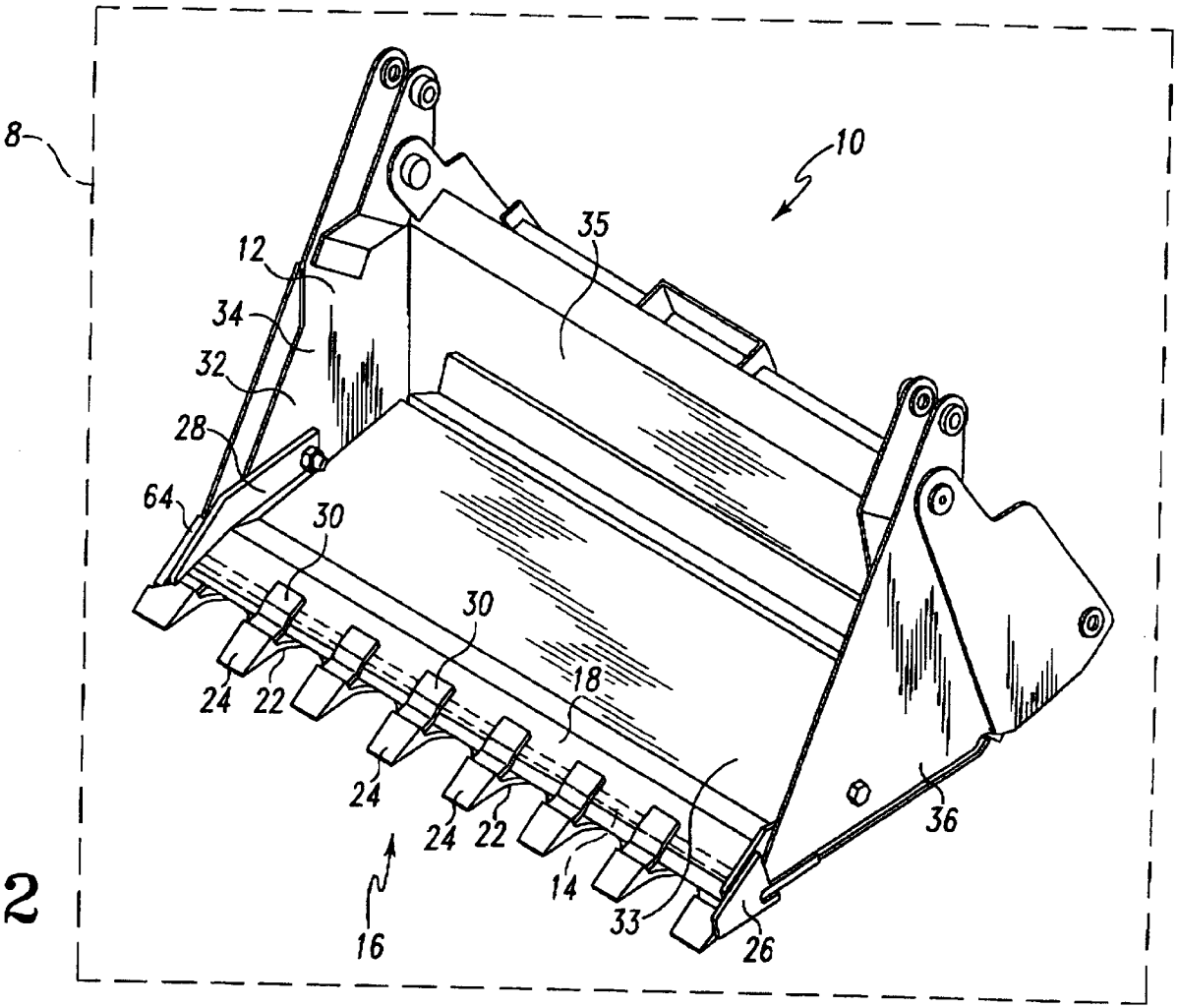
FIG. 2 is a perspective view of the bucket assembly of FIG. 1, with the base edge protection assembly secured to a base edge of the bucket.

Referring now to FIGS. 1 and 2, there is shown a work machine 8 which includes an implement assembly 10. Implement assembly 10 includes a bucket assembly, which incorporates the features of the present invention therein. Implement assembly 10 includes a bucket 12 and a base edge protection assembly 16. Bucket 12 includes wall segments 33, 34, 35, and 36. Bucket 12 also has a bucket cavity defined by wall segments 33, 34, 35, and 36. Wall segment 33 has a base edge 14 interposed between wall segments 34 and 36.

Figure 3:
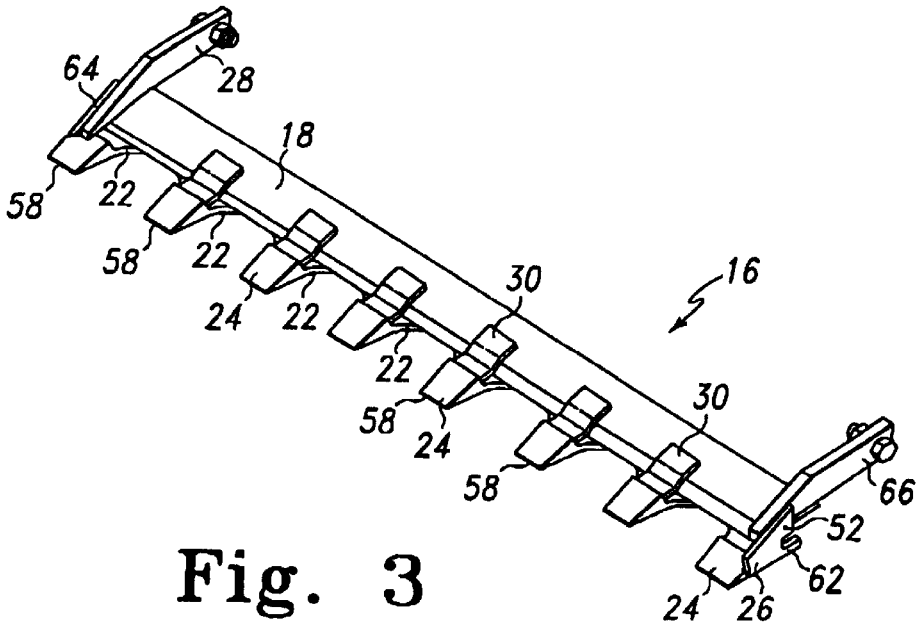
FIG. 3. is a perspective view of the base edge protection assembly of FIG. 1.
Figure 4:
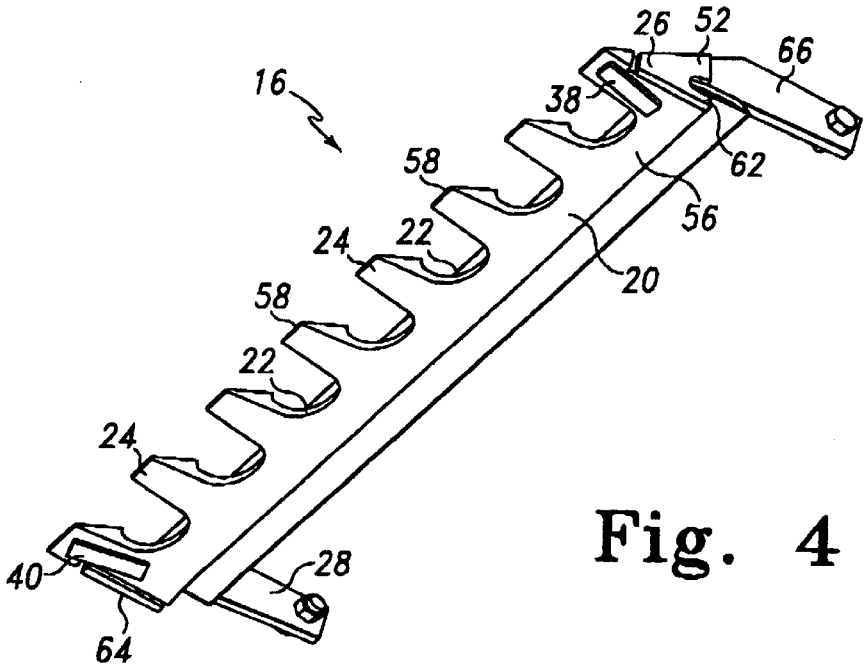
FIG. 4 is another perspective view of the base edge protection assembly shown in FIG. 1.
Figure 5:
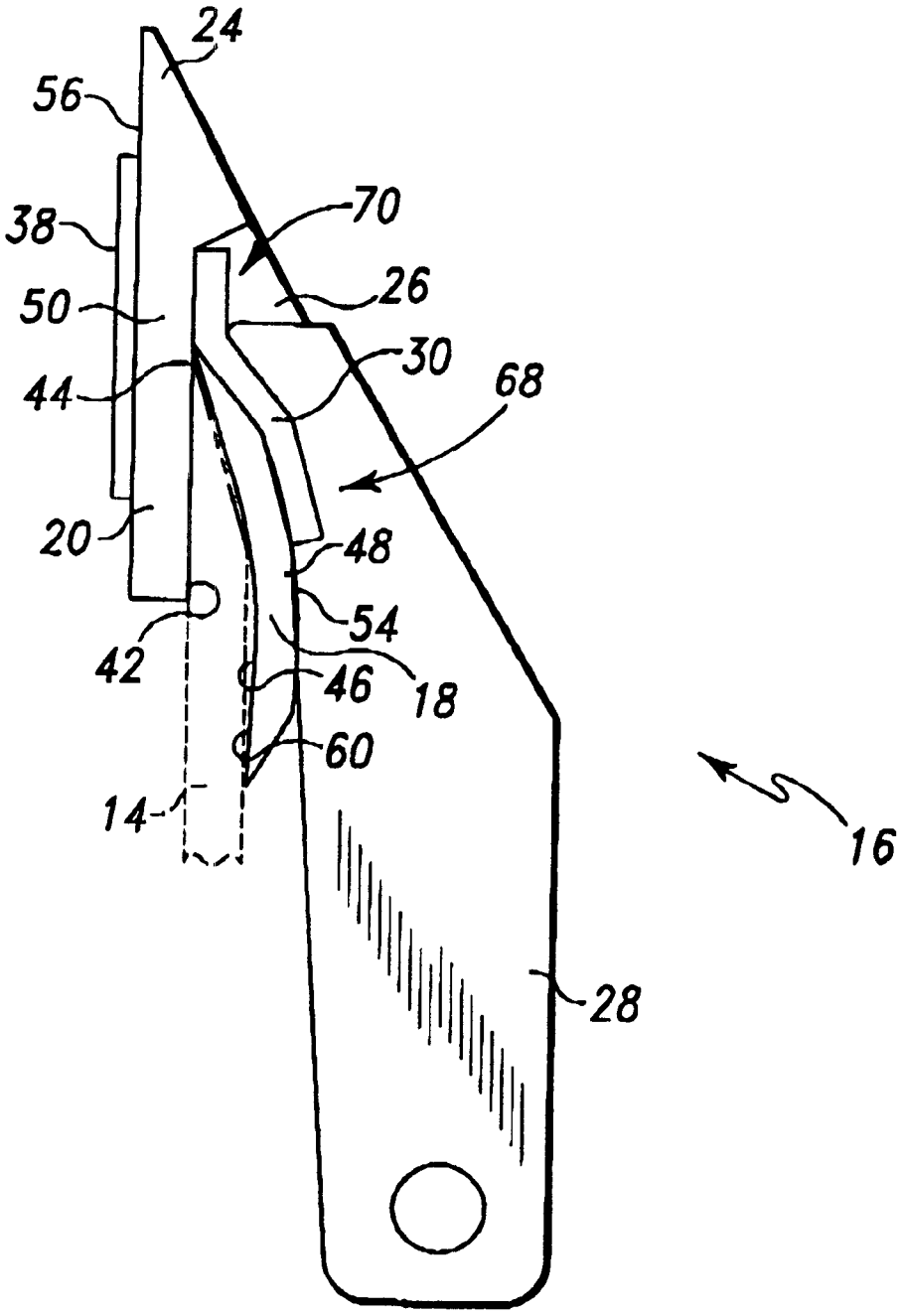
FIG. 5 is an end elevational view of the base edge protection assembly of FIG. 1 with the end brace and bracket removed (note that that a phantom view of the base edge of the bucket is shown positioned within the edge slot for clarity of description)

Referring now FIGS. 3, 4, and 5, base edge protection assembly 16 includes a cover plate 18, a digging plate 20, and a pair of end braces 26 and 64. Base edge protection assembly 16 also includes a pair of brackets 28 and 66, a pair of guard plates 38 and 40, and a number of straps 30.

As shown more clearly in FIG. 5, cover plate 18 has an arcuate shape such that cover plate has a convex surface 54 and a concave surface 60. Cover plate 18 also has an attachment edge 44.

Referring back to FIGS. 3 and 4, digging plate 20 has a forward edge 58, an upper surface 42 (see FIG. 5), and an under surface 56. Digging plate 20 also has a number of notches 22 defined in forward edge 58 so that a tooth 24 is formed from the portion of digging plate 20 that is interposed between notches 22. Preferably, notches 22 are flame cut into forward edge 58. It should be appreciated that the aforementioned notch 22 arrangement can also result in a tooth 24 which is not interposed between a pair of notches. Specifically, a tooth 24 can be formed on each end of digging plate 20 adjacent to a notch 22. It should also be appreciated that the above described method of forming digging plate 20 results in digging plate 20 having a tooth support member 21 with teeth 24 extending from tooth support member 21, wherein tooth support member 21 and teeth 24 are integrally formed together. Moreover, it should be appreciated that each tooth has the shape of a "half arrow head" as shown in FIG. 5.

As shown in FIG. 5, cover plate 18 is positioned relative to digging plate 20 such that attachment edge 44 of cover plate 18 contacts upper surface 42 of digging plate 20 behind teeth 24. Cover plate 18 is further positioned relative to digging plate 20 such that concave surface 60 of cover plate 18 faces upper surface 42 of digging plate 20. Once cover plate 18 is positioned relative to digging plate in the above described manner, cover plate 18 is secured to digging plate 20 by welding attachment edge 44 to upper surface 42. It should be appreciated that securing cover plate 18 to digging plate 20 in the above described manner results in an edge slot 46 being defined between cover plate 18 and digging plate 20. Specifically, edge slot 46 is interposed between concave surface 60 and upper surface 42.

Referring back to FIGS. 3 and 4, end brace 26 has an upper leg portion 52 and a lower leg portion 62. End brace 26 is positioned relative to cover plate 18 and digging plate 20 such that upper leg portion 52 of end brace 26 contacts an end edge 48 of cover plate 18. End brace 26 is further positioned relative to cover plate 18 and digging plate 20 such that lower leg portion 62 contacts an end edge 50 of digging plate 20. Once positioned in the above described manner (i) upper leg portion 52 is welded to end edge 48 and (ii) lower leg portion 62 is welded to end edge 50.

It should be appreciated that (i) end brace 62 also has an upper leg portion (not shown) and a lower leg portion (not shown) and (ii) that end brace 62 is secured to the opposite end edges of cover plate 18 and digging plate 20 in a substantially identical manner.

Bracket 66 is welded to upper leg portion 52 of end brace 26. In a substantially identical manner, bracket 28 is welded to the upper leg portion of end brace 64.

As shown in FIG. 5, each strap 30 is positioned relative to cover plate 18 and digging plate 20 such that each strap 30 is located directly behind a tooth 24. Each strap 30 is further positioned relative to cover plate 18 and digging plate 20 so as to have (i) a portion 68 in contact with convex surface 54 of cover plate 18 and (ii) a portion 70 in contact with upper surface 42 of digging plate 20. Once positioned as described above, (i) portion 68 is welded to convex surface 54 and (ii) portion 70 is welded to upper surface 42.

As shown in FIG. 4, guard plate 38 is welded to under surface 56 of digging plate 20 such that guard plate 20 is adjacent to lower leg portion 62 of end brace 26. Guard plate 40 is welded to under surface 56 of digging plate 20 such that guard plate 40 is adjacent to the lower leg portion of end brace 64. Guard plate 38 helps protect the weld between lower leg portion 62 and end edge 50 against the wear and tear encountered during an excavation process. Guard plate 40 performs a substantially identical function with respect to end brace 64.

It should be understood that abrasion resistant material can be applied to select portions of base edge protection assembly 16 so as to enhance the wear characteristics thereof. For example, U.S. Pat. No. 5,111,600 to Lukavich et al., the disclosure of which is incorporated herein by reference, discloses applying hard material to selected surfaces of bucket teeth to increase their wear life. This method of applying a hardened material to enhance the wear life of bucket teeth can also be used to enhance the wear life of base edge protection assembly 16 of the present invention.

Referring now to FIGS. 1 and 2, base edge protection assembly 16 is positioned relative to bucket 12 such that base edge 14 of wall segment 33 is aligned with edge slot 46. Base edge protection assembly 16 is then advanced toward bucket 12 such that (i) base edge 14 is located within edge slot 46 and (ii) brackets 28 and 66 extend into bucket cavity 32. Bracket 28 is then secured to wall segment 34 via a nut and bolt. Bracket 66 is secured to wall segment 36 via a nut and bolt. Securing brackets 28 and 66 to wall segments 34 and 36 respectively, as described above attaches base edge protection assembly 16 to bucket 12 such that base edge 14 is located within in edge slot 46.

Referring now to FIGS. 6–9 there is shown another base edge protection assembly 72 which incorporates the features of the present invention therein. Base edge protection assembly 72 is structurally similar to, is constructed in a similar manner as, and possesses the same advantages as, base edge protection assembly 16. Furthermore, base edge protection assembly 72 can be utilized with bucket 12 of implement assembly 10 in a similar manner as described above for base edge protection assembly 16.

Figure 7:
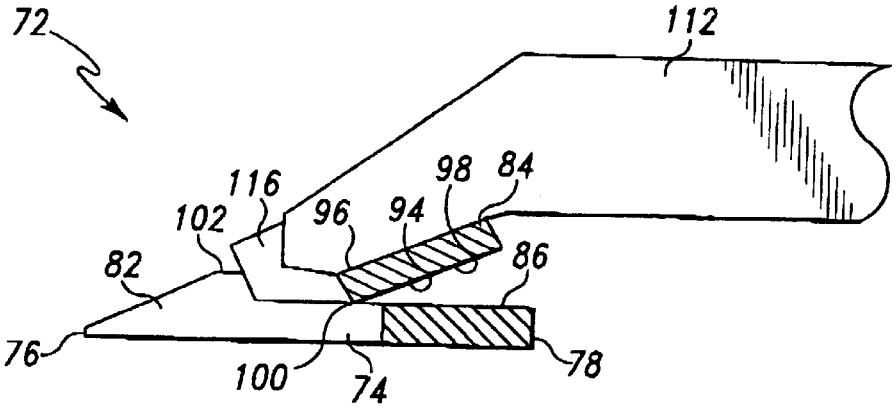
FIG. 7 is a cross sectional view of the base edge protection assembly taken along line 7—7 of FIG. 6 as viewed in the direction of the arrows.
Figure 8:
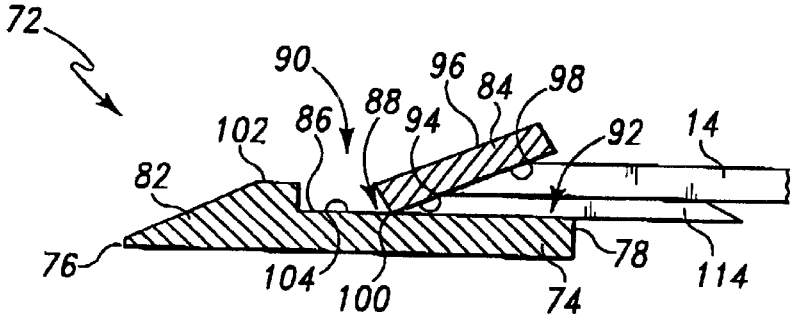
FIG. 8 is a cross sectional view of the base edge protection assembly taken along line 8—8 of FIG. 6 as viewed in the direction of the arrows with the end brace, strap, and bracket removed, and the base edge and the cutting edge shown positioned within the edge slot, for clarity of description.
Figure 9:
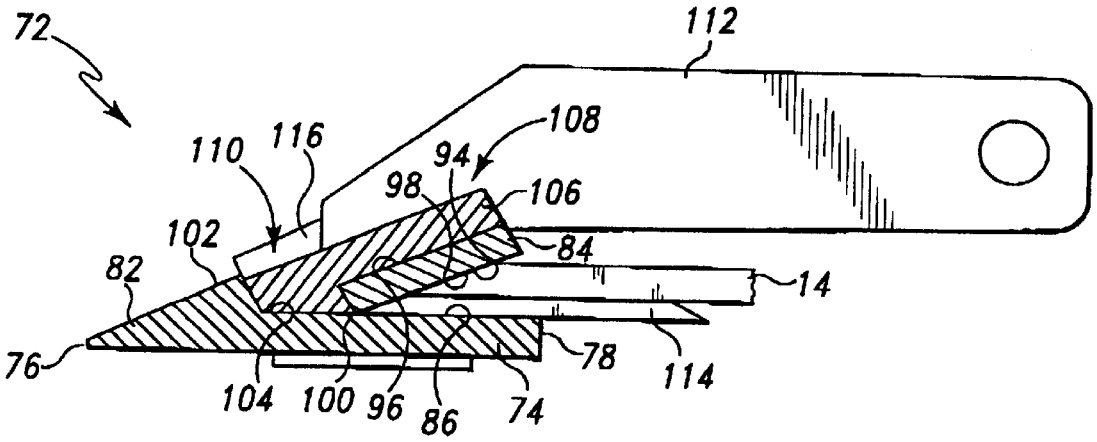
FIG. 9 is a cross sectional view of the base edge protection assembly taken along line 9—9 of FIG. 6 as viewed in the direction of the arrows.

As shown more clearly in FIGS. 7–9, base edge protection assembly 72 includes a digging plate 74 having (i) a first edge 76 and a second edge 78, (ii) a surface 86 interposed first edge 76 and second edge 78, and (iii) a plurality of notches 80 defined in first edge 76 of digging plate 74 so that a number of teeth 82 are integrally formed on digging plate 74. Base edge protection assembly 72 also includes a cover plate 84 secured to surface 86 of digging plate 74. In particular, cover plate 84 has an attachment edge 100 which is secured (e.g. welded) to surface 86 of digging plate 74 at a location 88 (see FIG. 8) interposed first edge 76 and second edge 78 so that (i) a first portion 90 of surface 86 extends outwardly from location 88 in a first direction, (ii) a second portion 92 of surface 86 extends outwardly from location 88 in a second direction, and (iii) an edge slot 94 is defined between digging plate 74 and cover plate 84. Attaching cover plate 84 to digging plate 74 in the above described manner results in (i) an upper surface 96 of cover plate 84 facing away from surface 86 of digging plate 74 and (ii) a lower surface 98 of cover plate 84 facing toward surface 86 of digging plate 74. Note that upper surface 96 and lower surface 98 of cover plate 84 are substantially flat.

As clearly shown in FIG. 8, each tooth 82 has a "half arrow head" shape. In addition, each tooth 82 includes a shoulder portion 102 attached to surface 86 of digging plate 74 so that each shoulder portion 102 extends outwardly from surface 86. Note that cover plate 84 is spaced apart from each shoulder portion 102 so that a gap space 104 is defined between each shoulder portion 102 and cover plate 84.

As shown in FIG. 9, base edge protection assembly 72 also includes a number of straps 106. Each strap 106 has (i) a first end 108 secured to cover plate 84 and (ii) a second end 110 secured to digging plate 74 so that second end 110 is located within a gap space 104. In particular, each strap 106 is welded to cover plate 84 and digging plate 74 in the above described manner.

Figure 6:
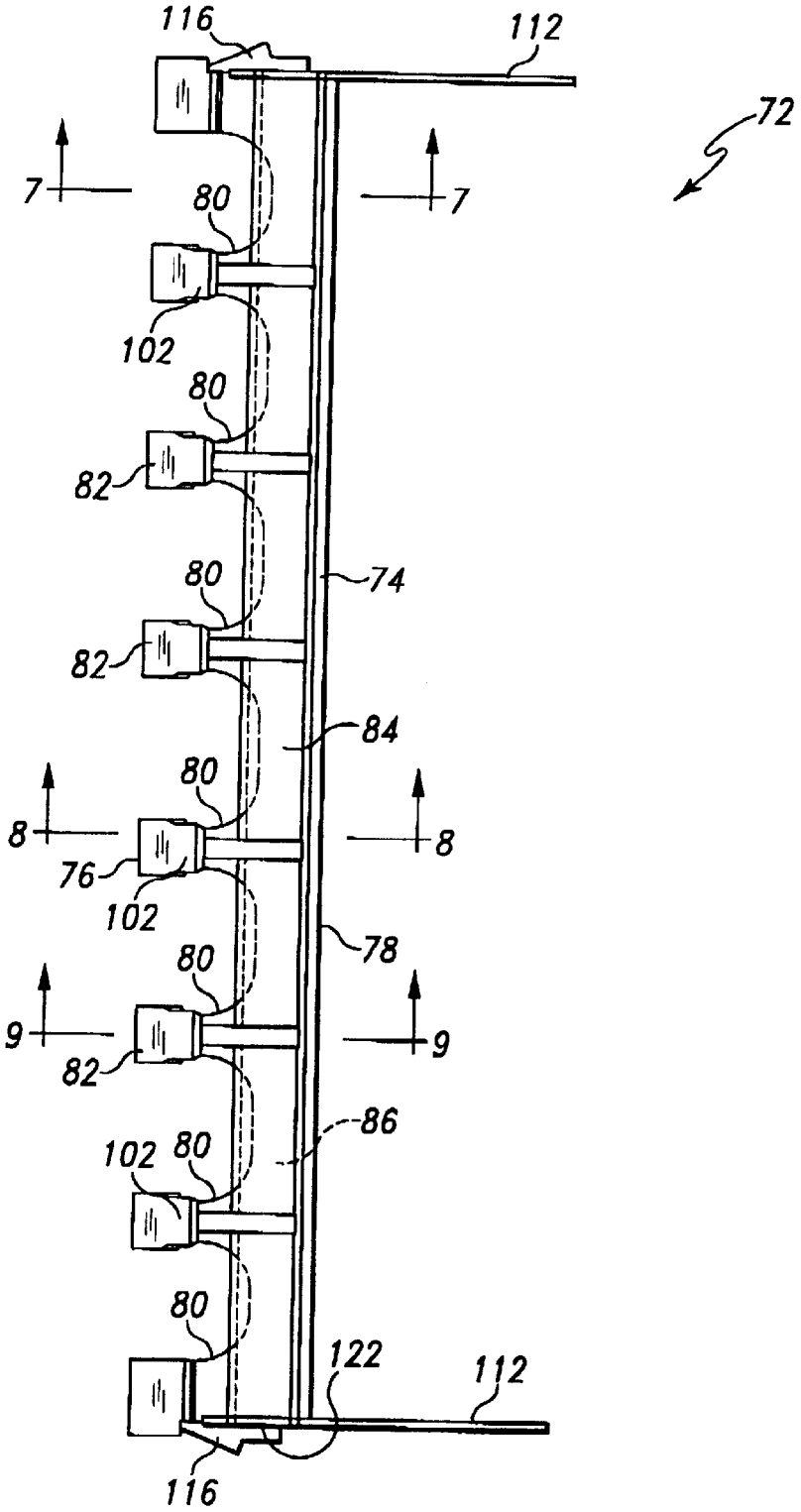
FIG. 6 is a top elevational view of another base edge protection assembly which can be secured to the base edge of the bucket of FIG. 1.
Figure 10:
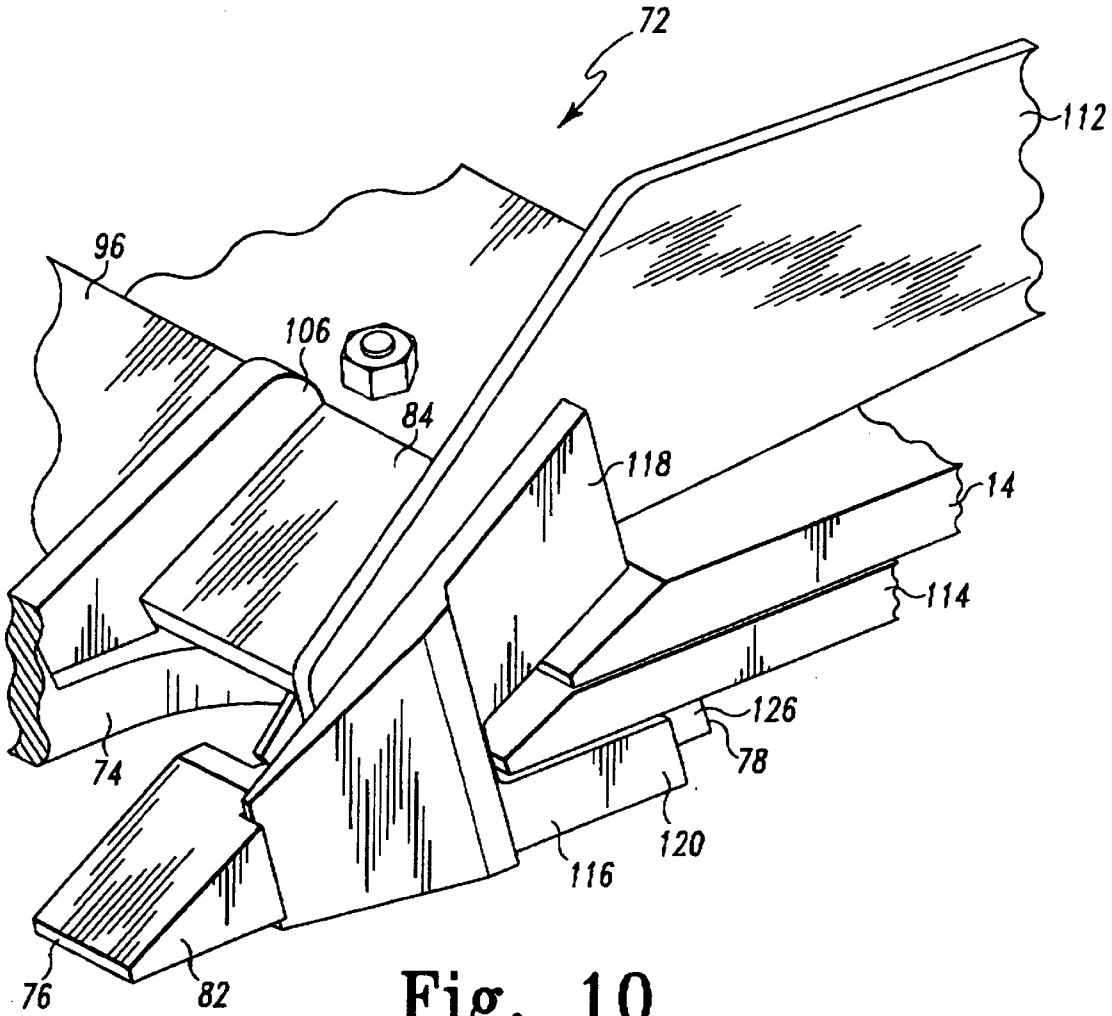
FIG. 10 is a fragmentary perspective view of the base edge protection assembly of FIG. 9 with a base edge of the bucket and a cutting edge plate located in the edge slot.

Referring now to FIG. 6, base edge protection assembly 72 further includes a pair of brackets 112 and a pair of end braces 116. Both end braces 116 are substantially identical and thus only one end brace 116 will be discussed in detail herein. As shown in FIG. 10, end brace 116 has an upper leg portion 118 and a lower leg portion 120. End brace 116 is positioned relative to cover plate 84 and digging plate 74 such that upper leg portion 118 of end brace 116 contacts an end edge 122 (see FIG. 6) of cover plate 84. End brace 116 is further positioned relative to cover plate 84 and digging plate 74 such that lower leg portion 120 contacts an end edge 126 of digging plate 74. Once positioned in the above described manner (i) upper leg portion 118 is welded to end edge 122 and (ii) lower leg portion 120 is welded to end edge 126. The other end brace 116 is attached to opposite end edges of cover plate 84 and digging plate 74 in a substantially identical manner. One bracket 112 is welded to upper leg portion 118 of each end brace 116. Bracket 112 can also be welded to upper surface 96 of cover plate 84.

As shown in FIGS. 8, 9, and 10, base edge protection assembly 72 is positioned relative to bucket 12 in a substantially identical manner as described above for base edge protection assembly 16. In particular, base edge protection assembly 72 is positioned relative to bucket 12 such that base edge 14 of wall segment 33 (see FIG. 1) is aligned with edge slot 94. Base edge protection assembly 72 is then advanced toward bucket 12 such that (i) base edge 14 is located within edge slot 94 and (ii) brackets 112 extend into bucket cavity 32. Brackets 112 are then bolted to wall segments 34 and 36. Securing brackets 112 wall segments 34 and 36 as described above attaches base edge protection assembly 72 to bucket 12 such that base edge 14 is located within in edge slot 94. Note that as shown in FIGS. 8–10, base edge 14 can have a cutting edge plate 114 secured thereto in a well known manner so that when base edge 14 is positioned within edge slot 94, cutting edge plate 114 is also positioned within edge slot 94. It should be appreciated that having upper surface 96 and lower surface 98 of cover plate 84 substantially flat facilitates the positioning of cutting edge plate 114 within edge slot 94.

INDUSTRIAL APPLICABILITY

Implement assembly 10 can be utilized to excavate earth during the performance of a work function. Having base edge protection assembly 16 or 72 attached to bucket 12 in the above described manner during an excavation process has several advantages as will be discussed below in reference to base edge protection assembly 16, however, it should understood that these advantages also apply to base edge protection assembly 72. For example, one advantage of base edge protection assembly 16 is that teeth 24 thereof facilitates the ability of implement assembly 10 to penetrate the ground, which in turn enhances the ability of implement assembly 10 to perform a digging function. In addition, having base edge 14 located within edge slot 46 of base edge protection assembly 16 protects base edge 14 of bucket 12 from the wear and tear implement assembly 10 encounters during an excavation process. Protection of the base edge 14 extends the life of bucket 12 and reduces the maintenance cost of implement assembly 10. Moreover, it should be understood that base edge protection assembly 16 can be easy removed from bucket 12 once base edge protection assembly 16 wears out. Specifically, brackets 28 and 66 can be detached from wall segments 34 and 36 respectively, and base edge protection assembly 16 removed from bucket 12. Once removed, a replacement base edge protection assembly 16 can be attached to bucket 12 in a manner substantially identical as previously discussed.

An additional advantage of base edge protection assembly 16 is that digging plate 20 is a unitary metallic plate (e.g. steel) with teeth 24 being formed by cutting notches into forward edge 58 of digging plate 20. Forming teeth 24 in the above described manner results in teeth 24 being integral to digging plate 20, and thus ensures that teeth 24 will not inadvertently become separated from bucket 12 during the performance of a work function. This is in contrast to other base edge protection or tooth bar assemblies which utilize adapters and pin assemblies to secure the teeth. These types of tooth bar assemblies (i.e. ones that utilize adapters and pin assemblies) are more prone to having their teeth inadvertently detached due to the wear and tear the adapters and pin assemblies are subjected to during an excavation process.

Base edge protection assembly 16 has additional advantages over other tooth bar designs that utilize adapters and pin assemblies. For example, forming teeth 24 by cutting notches 22 into forward edge 58 of digging plate 20 rather that utilizing adapters and pin assemblies for attaching the teeth results in a base edge protection assembly that (i) has relatively fewer parts, (ii) is relatively inexpensive to manufacture, (iii) is not as mechanically complex, and (iv) is relatively easy to install.

While the invention has been illustrated and described in detail in the drawings and foregoing description, such illustration and description is to be considered as exemplary and not restrictive in character, it being understood that only the preferred embodiment has been shown and described and that all changes and modifications that come within the spirit of the invention are desired to be protected. Other aspects and features of the present invention can be obtained from a study of the drawings, the disclosure, and the appended claims.

What is claimed is:

1. A base edge protection assembly for an implement of a work machine, comprising:

a digging plate having (i) a first edge and a second edge, (ii) a surface interposed said first edge and said second edge, and (iii) a plurality of notches defined in said first edge of said digging plate so that a number of teeth are integrally formed on said digging plate, each of said teeth having a shoulder portion that extends outwardly from said surface;

a cover plate secured to said surface of said digging plate at a location interposed said first edge and said second edge and spaced apart from said shoulder portion so that (i) a first portion of said surface extends outwardly from said location in a first direction, (ii) a second portion of said surface extends outwardly from said location in a second direction, and (iii) an edge slot is defined between said digging plate and said cover plate, and (iv) a gap space is defined between said shoulder portion and said cover plate; and a strap having (i) a first end secured to said cover plate and (ii) a second end secured to said digging plate so that said second end is located within said gap space.

2. The base edge protection assembly of claim 1, wherein:

said cover plate has (i) an upper surface which faces away from said surface of said digging plate and (ii) a lower surface which faces toward said surface of said digging plate, and said upper surface is substantially flat.

3. The base edge protection assembly of claim 1, wherein:

each tooth has a half arrow head shape.

4. The base edge protection assembly of claim 1, wherein:

said cover plate includes an attachment edge, and said attachment edge is secured to said surface of said digging plate.

5. The base edge protection assembly of claim 1, further comprising:

a bracket secured to said cover plate.

6. The base edge protection assembly of claim 1, further comprising:

a cutting edge plate in contact with said surface of said digging plate.

7. An implement assembly, comprising:

a digging plate having (i) a first edge and a second edge (ii) a surface interposed said first and said second edge, and (iii) a plurality of notches defined in said first edge of said digging plate so that s number of teeth are integrally formed on said digging plate, each of said teeth having a shoulder portion that extends outwardly from said surface;

a cover plate secured to said surface of said digging plate as a location interposed said first edge and said second edge and spaced apart from said shoulder portion so that (i) a first portion of said surface extends outwardly from the location in a first direction, (ii) a second portion of said surface extends outwardly from said location in a second direction, (iii) an edge slot is defined between said digging plate and said cover plate, and (iv) a gap space is defined between said shoulder portion and said cover plate;

a strap having (i) a first end secured to said cover plate and (ii) a second end secured to said digging plate so that said second end is located within said gap space; and a bucket having a base edge, said bucket being positioned relative to said digging plate and said cover plate so that said base edge is located within said edge slot.

8. The implement assembly of claim 7, wherein:

said cover plate has (i) and upper surface which faces away from said surface of said digging plate and (ii) a lower surface which faces toward said surface of said digging plate, and said upper surface is substantially flat.

9. The implement assembly of claim 7, wherein:

each tooth has a half arrow head shape.

10. The implement assembly of claim 7, wherein:

said cover plate includes an attachment edge, and said attachment edge is secured to said surface of said digging plate.

11. The implement assembly of claim 7, further comprising:

a bracket secured to said cover plate.

12. The implement assembly of claim 11, further comprising:

a cutting edge plate in contact with said surface of said digging plate.

13. A work machine, comprising:

a digging plate having (i) a first edge and a second edge, (ii) a surface interposed said first edge and said second edge, and (iii) a plurality of notches defined in said first edge of said digging plate so that a number of teeth are integrally formed on said digging plate, each of said teeth having a shoulder portion that extends outwardly from said surface;

a cover plate secured to said surface of said digging plate at a location interposed said first edge and said second edge and spaced apart from said shoulder portion so that (i) a first portion of said surface extends outwardly from said location in a first direction, (ii) a second portion of said surface extends outwardly from said location in a second direction, (iii) an edge slot is defined between said digging plate and said cover plate, and (iv) a gap space is defined between said shoulder portion and said cover plate;

a strap having (i) a first end secured to said cover plate and (ii) a second end secured to said digging plate so that said second end is located within said gap space; and an implement having a base edge, said implement being positioned relative to said digging plate and said cover plate so that said base edge is located within said edge slot.

14. The work machine of claim 13, wherein:

said cover plate has (i) an upper surface which faces away from said surface of said digging plate and (ii) a lower surface which faces toward said surface of said digging plate, and said upper surface is substantially flat.

15. The work machine of claim 13, wherein:

each tooth has a half arrow head shape

16. The work machine of claim 13, wherein:

said implement includes a bucket.

* * * * *

UNITED STATES PATENT AND TRADEMARK OFFICE

CERTIFICATE OF CORRECTION

PATENT NO. : 6,434,865 B2
DATED : August 20, 2002
INVENTOR(S) : William J. Renski et al.

It is certified that error appears in the above-identified patent and that said Letters Patent is hereby corrected as shown below:

Column 8,
Line 11, "and" should be -- an --, so it reads as follows:
-- said cover plate has (i) an upper surface which faces --

Signed and Sealed this

Fourth Day of March, 2003

JAMES E. ROGAN
*Director of the United States Patent and Trademark Office*